US005360262A

United States Patent [19]

Davidian

[11] Patent Number: 5,360,262

[45] Date of Patent: Nov. 1, 1994

[54] SAFETY DEVICE FOR MOVABLE STORAGE UNITS

[75] Inventor: Avner Davidian, Edison, N.J.

[73] Assignee: White Storage and Retrieval Systems, Inc., Kenilworth, N.J.

[21] Appl. No.: 19,745

[22] Filed: Feb. 19, 1993

[51] Int. Cl.[5] ..... A47B 87/00; A47B 53/00

[52] U.S. Cl. ..... 312/201; 70/DIG. 9; 74/577 M

[58] Field of Search ..... 74/577 M, 411.5, 813 L; 70/DIG. 9; 312/198, 200, 201; 188/82.1-82.34

[56] References Cited

U.S. PATENT DOCUMENTS

| | | | |
|---|---|---|---|
| 3,598,214 | 8/1971 | Harris | 74/411.5 X |
| 3,601,231 | 8/1971 | Kolacz et al. | 74/411.5 X |
| 4,519,483 | 5/1985 | Schlicker | 74/411.5 X |
| 4,523,794 | 6/1985 | Peterman | 312/201 |
| 4,607,896 | 8/1986 | Peterman | 312/201 |
| 4,616,888 | 10/1986 | Peterman | 312/201 |
| 4,616,889 | 10/1986 | Peterman | 312/201 |
| 4,708,411 | 11/1987 | Peterman | 312/201 |

*Primary Examiner*—Stephen C. Pellegrino
*Assistant Examiner*—Nancy Mulcare
*Attorney, Agent, or Firm*—Lerner, David, Littenberg, Krumholz & Mentlik

[57] ABSTRACT

A locking mechanism for a system of movable storage units is actuated passively to prevent the storage units from moving back toward one another once an access aisle has been created therebetween. The locking mechanism includes a first gear which rotates with the operating handle during movement of a storage unit and a floating gear mounted to a support plate so that it meshes with the first gear. After a storage unit has been moved in one direction to create an access aisle, rotating the operating handle to move the storage unit in the opposite direction to close the aisle will cause the support member and floating gear to pivot toward a position in which the floating gear is engaged with an arresting member, whereupon the storage unit will be locked from movement in that opposite direction. A logic system controls the actuation of the locking mechanism responsive to the position of the storage unit with respect to adjacent storage units.

33 Claims, 8 Drawing Sheets

SAFETY DEVICE FOR MOVABLE STORAGE UNITS

FIELD OF THE INVENTION

The present invention relates generally to movable storage systems, and more particularly to a device for locking the individual storage units of such systems in place. Still more particularly, the invention relates to a system which, upon the creation of an access aisle between adjacent storage units, automatically locks the units from moving toward one another to close the access aisle.

BACKGROUND OF THE INVENTION

Movable storage systems have gained widespread popularity as a means for maximizing the storage capacity of a confined space. These devices typically consist of a plurality of storage units which can be moved independently along a pair of guide rails mounted on the floor to create an access aisle between any two adjacent storage units.

Safety considerations make it desirable that the storage units not be moveable when a person is present in the access aisle. For that reason, much effort has gone into developing various types of mechanisms which enable the storage units to be selectively locked in place so that the access aisle is not closed unintentionally. Many of the locking and unlocking mechanisms available heretofore require manual actuation by a user. Not surprisingly, users often forget to actuate these mechanisms before entering the access aisle, thereby creating a potential for injury.

In view of the foregoing, attempts have been made to provide passive locking and unlocking systems which automatically lock the storage units from moving toward one another once an access aisle between the storage units has been created. One such system is disclosed in U.S. Pat. No. 5,160,189. This patent describes a storage unit having an internal toothed locking wheel operatively connected to the wheels of the storage unit, a pair of actuating members connected by pawls to the locking wheel, and a scissors mechanism connected between adjacent storage units. As the storage units are moved away from one another to create an access aisle therebetween, the scissors mechanism actuates the actuating members to move the pawls into engagement with the locking wheel in such a way that the locking wheel and thus the storage units can continue moving in the same direction, but so that the locking wheel and thus the storage units are prevented from moving in a reverse direction. A major disadvantage of this system is that, once the pawls have engaged the locking wheel, continued movement of the storage units away from one another in order to enlarge the access aisle causes the pawls to ratchet over the locking wheel so that an annoying clicking sound is produced. This sound is particularly disturbing in the office environments in which these movable storage systems are frequently situated.

There therefore exists a need for improvements in the locking systems used to maintain an open aisle between the adjacent storage units of a movable storage system, and more particularly in those locking systems which are actuated passively without the need for a deliberate action on the part of the user. Preferably, such locking systems will have a simple construction requiring little or no maintenance and will operate silently so as to not create a distraction in the work environment.

SUMMARY OF THE INVENTION

The present invention addresses these needs.

One aspect of the present invention provides a locking mechanism consisting of a frame, a shaft rotatably mounted to the frame, means for rotating the shaft, a first gear mounted on the shaft for rotation therewith, a support member mounted for movement with respect to the frame in a first path between a first lock position and a free run position, and a second gear mounted on the support member for rotation relative to the support member, the second gear being in mesh with the first gear. In a preferred arrangement, the axis of rotation of the shaft is parallel to the axis of rotation of the second gear.

A first arresting member is mounted to the frame for engaging the second gear to thereby prevent rotation of the shaft in a first direction when the support member is in the first lock position, the first arresting member being disengaged from the second gear when the support member is in the free run position. This first arresting member may consist of a toothed member. Movement means are provided for urging the support member toward the first lock position responsive to rotation of the shaft in the first direction, and blocking means are provided for selectively blocking the movement of the support member to the first lock position.

In accordance with one embodiment of the locking mechanism, the movement means consists of drag means for rotatably coupling the support member to the first gear. In a preferred embodiment, the drag means includes biasing means for creating a coupling force to rotatably couple the support member to the first gear. Preferably, the coupling force rotatably couples the support member to the second gear. The movement means may urge the support member toward the free run position responsive to rotation of the shaft in a second direction.

In accordance with another embodiment, the blocking means consists of a first blocking member movable into the first path for blocking the movement of the support member to the first lock position and movable out from the first path for releasing the support member for movement into the first lock position. Preferably, the locking mechanism in accordance with this embodiment further includes reset means for moving the support member from the first lock position to the free run position.

In yet another embodiment of the present invention, the support member is further movable in a second path between a second lock position and the free run position, the locking mechanism further including a second arresting member mounted to the frame for engaging the second gear to thereby prevent rotation of the shaft in a second direction when the support member is in the second lock position, the second arresting member being disengaged from the second gear when the support member is in the free run position. Preferably, the first and second arresting members in accordance with this embodiment consist of toothed members. In a more preferred embodiment, the movement means urges the support member toward the second lock position responsive to rotation of the shaft in the second direction. The movement means may consist of drag means for rotatably coupling the support member to the first gear. In that case, the drag means preferably consists of biasing means for creating a coupling force to rotatably couple the support member to the first gear. More preferably, the coupling force rotatably couples the support member to the second gear. The blocking means in this embodiment preferably comprises a first blocking member movable into the first path for blocking the movement of the support member to the first lock position and movable out from the first path for releasing the support member for movement into the first lock position, and a second blocking member movable into the second path for blocking the movement of the support member to the second lock position and movable out from the second path for releasing the support member for movement into the second lock position. In a highly preferred embodiment, the locking mechanism further includes reset means for moving the support member from the first and second lock positions to the free run position.

Another aspect of the present invention provides a movable storage system consisting of a first movable storage unit having a frame, a drive mechanism including a shaft rotatably mounted to the frame for moving the storage unit in forward and reverse directions, and locking means for selectively preventing the movement of the storage unit in at least one of the forward and reverse directions. The locking means includes a first gear mounted on the shaft for rotation therewith, a support member mounted for movement with respect to the frame in a first path between a first lock position and a free run position, and a second gear mounted on the support member for rotation relative to the support member, the second gear being in mesh with the first gear. The axes of rotation of the shaft and of the second gear are preferably oriented in parallel directions.

A first arresting member is mounted to the frame for engaging the second gear to thereby prevent rotation of the shaft in a first direction when the support member is in the first lock position, the first arresting member being disengaged from the second gear when the support member is in the free run position. The locking means also includes movement means for urging the support member toward the first lock position responsive to rotation of the shaft in the first direction, and blocking means for selectively blocking the movement of the support member to the first lock position. The blocking means may consist of a first blocking member moveable into the first path for blocking the movement of the support member into the first lock position and moveable out from the first path for releasing the support member for movement into the first lock position.

In one embodiment, this movable storage system further includes a second storage unit positioned so that movement of the first storage unit in the forward direction moves the first storage unit toward the second storage unit and movement of the first storage unit in the reverse direction moves the first storage unit away from the second storage unit. In accordance with this embodiment, the movable storage unit includes control means for controlling the movement of the first blocking member in response to a distance between the first and second storage units. The control means may consist of a first operating mechanism including a first operating arm movable between an extended position when the distance between the first and second storage units is greater than a threshold distance and a retracted position when the distance between the first and second storage units is less than the threshold distance, and response means for moving the first blocking member into the first path responsive to movement of the first operating arm from the extended position to the retracted position. In preferred embodiments, the response means includes a first linking arm connected to the first blocking member and first cam means operable between the first linking arm and the first operating arm for moving the first blocking member with respect to the first path in response to movement of the first operating arm between the extended and retracted positions. Preferably, reset means are provided for moving the support member from the first lock position to the free run position.

In another embodiment, the movable storage system may include second and third storage units positioned so that movement of the first storage unit in the forward direction moves the first storage unit toward the second storage unit and away from the third storage unit, and movement of the first storage unit in the reverse direction moves the first storage unit away from the second storage unit and toward the third storage unit. In accordance with this embodiment, control means are provided for controlling the movement of the first blocking member in response to a first distance between the first and second storage units and for controlling the movement of the second blocking member in response to a second distance between the first and third storage units.

In this last embodiment, the control means preferably consists of a first operating mechanism including a first operating arm movable between an extended position when the distance between the first and second storage units is greater than a threshold distance and a retracted position when the distance between the first and second storage units is less than the threshold distance, and first response means for moving the first blocking member into the first path responsive to movement of the first operating arm from the extended position to the retracted position. The control means may further consist of a second operating mechanism including a second operating arm movable between an extended position when the distance between the first and third storage units is greater than the threshold distance and a retracted position when the distance between the first and third storage units is less than the threshold distance, and second response means for moving the second blocking member into the second path responsive to movement of the second operating arm from the extended position to the retracted position. In highly preferred embodiments, the first response means includes a first linking arm connected to the first blocking member and first cam means operable between the first linking arm and the first operating arm for moving the first blocking member with respect to the first path in response to movement of the first operating arm between the extended and retracted positions. Likewise, the second response means preferably includes a second linking arm connected to the second blocking member and second cam means operable between the second linking arm and the second operating arm for moving the second blocking member with respect to the second path in response to movement of the second operating arm between the extended and retracted positions.

In more highly preferred embodiments, the movable storage system further includes reset means for moving the support member from the first and second lock positions to the free run position. Preferably, the reset means includes a reset lever operatively connected to the first and second linking arms, wherein movement of the reset lever from a rest position to a reset position simultaneously moves the first blocking member into the first path and the second blocking member into the second path.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
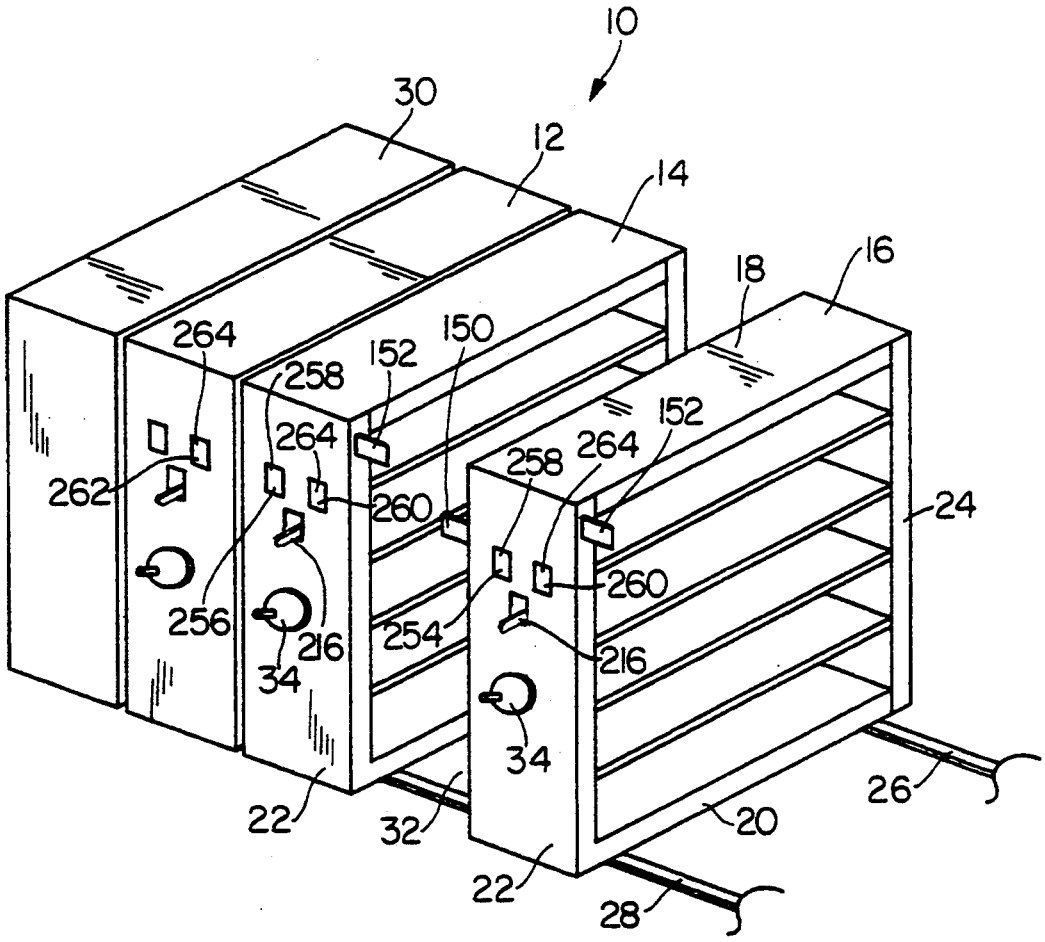
FIG. 1 is a perspective view of a movable storage system incorporating the locking system of the present invention.

The locking mechanism and logic system of the present invention are described herein in connection with manually movable storage systems, such as the storage system 10 illustrated in FIG. 1. Such storage systems typically include a plurality of wheeled storage units 12, 14 and 16 which are mounted on a pair of guide rails 26 and 28 positioned on the floor of an office or other storage location, each storage unit including a top 18, a bottom 20 and a pair of opposed end members 22 and 24. Storage units 12, 14 and 16 are independently movable with respect to a stationary storage unit 30 to create an access aisle 32 in a desired location between any two storage units. Thus, by rotating an operating handle 34 in a clockwise direction, each of storage units 12, 14 and 16 may be moved in a forward direction away from stationary storage unit 30, and by rotating operating handle 34 in a counterclockwise direction, each of storage units 12, 14 and 16 may be moved in a reverse direction toward stationary storage unit 30. Storage system 10 may also be arranged so that the movement of any one of storage units 12, 14 and 16 in either the forward or reverse directions will push those storage units immediately preceding that storage unit in the same movement direction.

Each of storage units 12, 14 and 16 is provided with a driving mechanism for moving the storage unit along guide rails 26 and 28. In a typical arrangement, operating handle 34 is connected by a rotatable shaft and a series of sprockets and endless chains to one of the wheels mounted on the bottom of the storage unit. Through this arrangement, rotation of the operating handle 34 will be transmitted to the driven wheel and will thus result in movement of the storage unit in either a forward or reverse direction depending upon the direction of rotation of the operating handle. Since mechanisms of this type for driving moveable storage units are well known in the art, a more detailed description of each of the components and the operation of such mechanism will not be included herein.

Figure 2A:
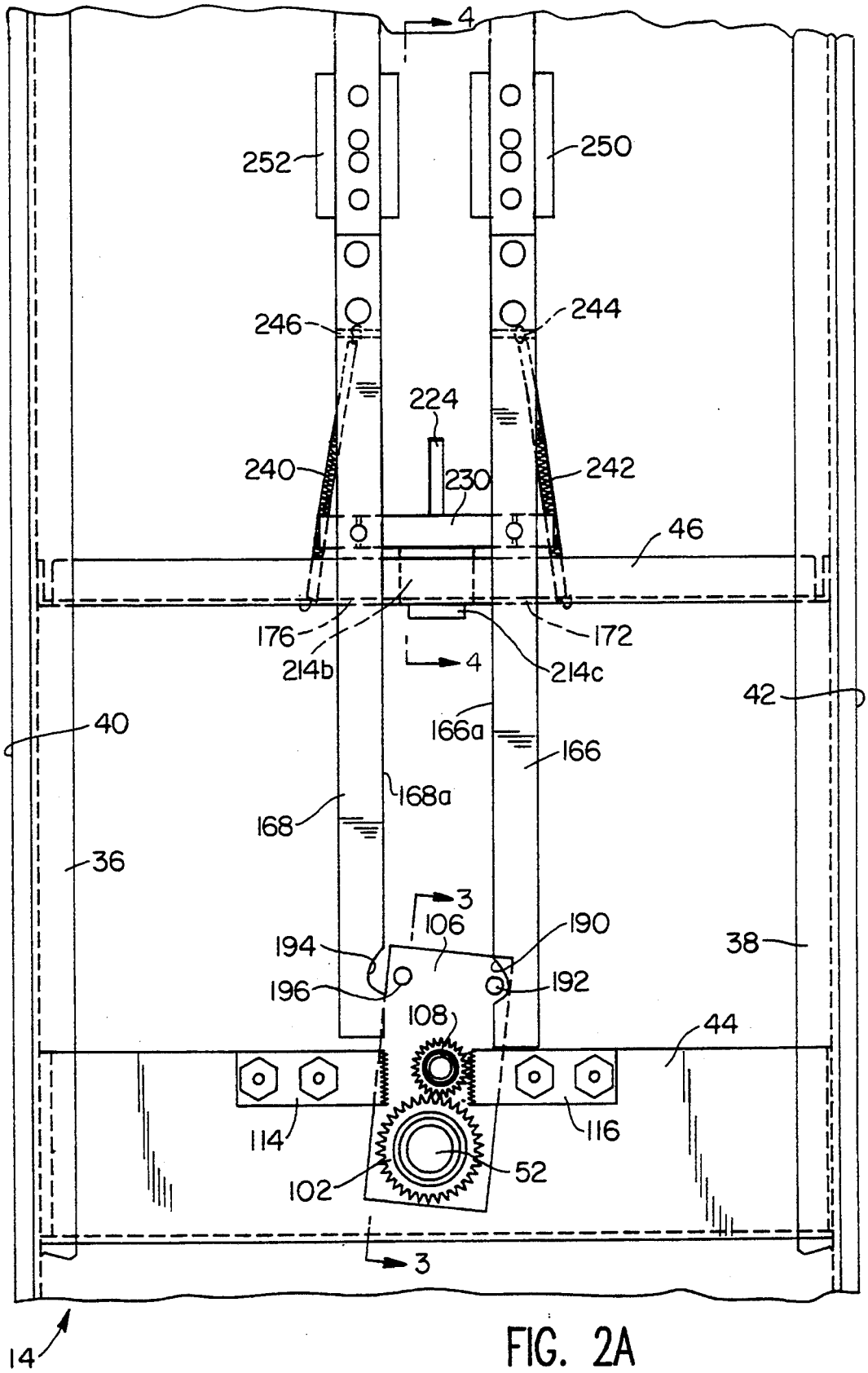
FIGS. 2A and 2B are enlarged, schematic, partial rear elevational views showing the locking mechanism of the present invention in a single storage unit, as well as the logic system for actuating same.
Figure 3:
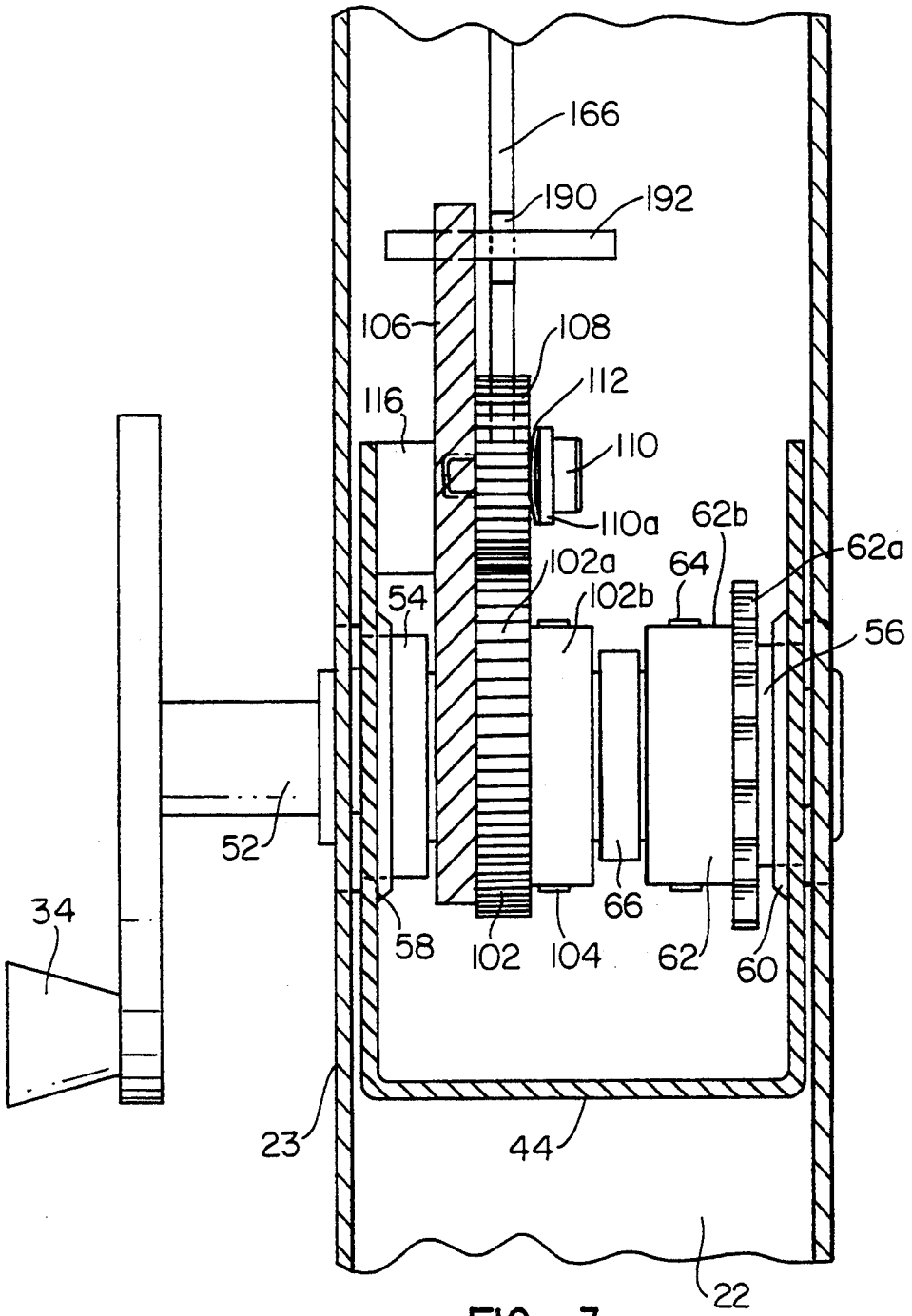
FIG. 3 is an enlarged, schematic, cross-sectional view taken along line 3—3 of FIG. 2A.

In order to lock storage units 12, 14 and 16 in place to prevent undesirable movement, each storage unit is provided with a passive locking mechanism in accordance with the present invention. As used to describe the locking mechanisms herein, the term "passive" refers to the automatic actuation of the locking mechanism of a given storage unit upon the movement of that storage unit away from an adjacent storage unit by a predetermined amount. As the locking mechanisms on storage units 12, 14 and 16 are identical, only the locking mechanism 100 on storage unit 14 will be described herein. Referring to FIGS. 2A and 3, the end member 22 of storage unit 14 includes a frame formed by a pair of C-shaped frame members 36 and 38 extending along the front and back edges 40 and 42 of the end member, respectively, between the top 18 and the bottom 20 thereof, and a number of C-shaped cross members 44, 46, 48 and 50 extending therebetween.

A drive shaft 52 is rotatably mounted to frame cross member 44 through a pair of flanged bushings 54 and 56 held in assembled position to frame cross member 44 by retaining clips 58 and 60. Shaft 52 includes a drive sprocket 62 having a toothed portion **62*a* which engages an endless chain (not shown) and thus forms a portion of the driving mechanism of storage unit 14, and a flange portion 62*b*. A roll pin 64 extends through flange portion 62*b* and shaft 52 to connect sprocket 62 for rotation with shaft 52. Shaft 52 also includes a gear 102 having a toothed portion 102*a* and a flange portion 102*b*. Gear 102 is connected for rotation with shaft 52 by a roll pin 104 which extends through flange portion 102*b* and shaft 52. Optionally, a spacer 66 may be assembled on shaft 52 between gear 102 and sprocket 62. Adjacent gear 102, a support plate 106 is loosely assembled on shaft 52 so that shaft 52 is capable of rotating relative to the support plate. Operating handle 34 is connected to a portion of shaft 52 which extends beyond an outer panel 23 to the exterior of end member 22**.

A floating gear 108 is mounted to support plate 106 by a bolt 110 such that the teeth of gear 108 are in mesh with the toothed portion **102*a* of gear 102. A spring washer 112 positioned between gear 108 and a flange 110*a* on bolt 110 creates a clutch effect so that, in one condition of locking mechanism 100, support plate 106 rotates with gear 102, and in another condition of locking mechanism 100, support plate 106 does not rotate with gear 102. More particularly, if locking mechanism 100 is in a condition such that the rotation of support plate 106 is unrestricted, as gear 102 is rotated, gear 108 will not rotate with respect to support plate 106, but rather the support plate will rotate along with gear 102. On the other hand, if locking mechanism 100 is in a condition in which the rotation of support plate 106 is somehow restricted, rotating gear 102 will cause gear 108 to rotate with respect to support plate 106 in a direction opposite that of gear 102. The same clutch effect can be obtained by mounting a spring washer or other biasing member on shaft 52 between gear 102 and support plate 106** or on either side of these elements to create a force rotationally coupling these elements together.

Fixedly assembled to frame cross member 44 on either side of gear 108 are a pair of racks 114 and 116. Racks 114 and 116 are positioned in the plane of gear 108 and are sufficiently spaced therefrom so that gear 108 is not engaged with either rack 114 or rack 116 in a generally vertical position of support plate 106, but so that the teeth of gear 108 will become meshed with the teeth of rack 114 as support plate 106 pivots in the counterclockwise direction of FIG. 2A and will become meshed with the teeth of rack 116 as support plate 106 pivots in the clockwise direction of FIG. 2A. It will be appreciated from the discussion regarding the operation of locking mechanism 100 hereinbelow that racks 114 and 116 can be replaced with gears, pawls or other mechanical elements which are capable of meshing with or engaging the teeth of gear 108 to prevent the further rotation of the gear.

Figure 2B:
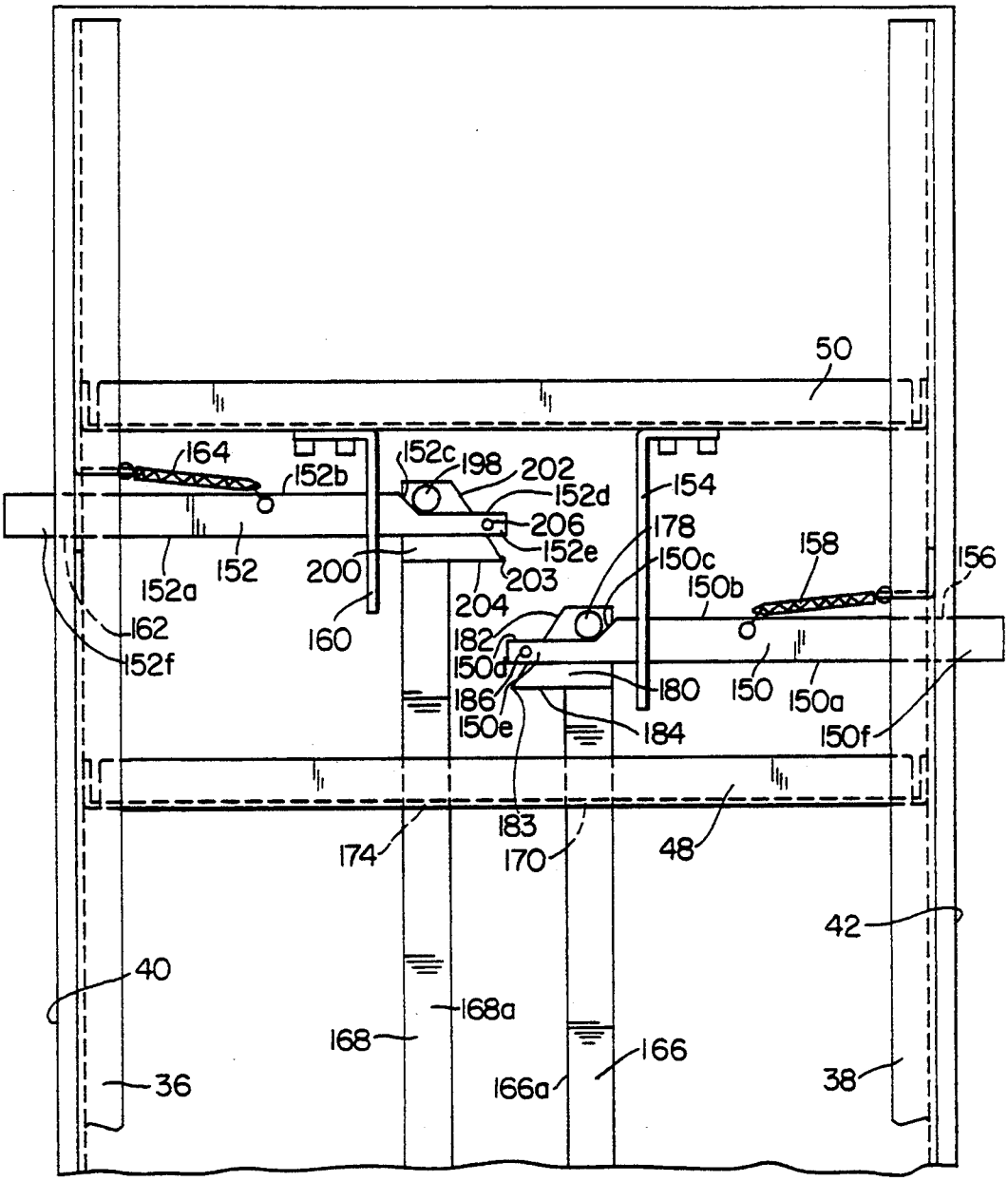

Storage unit 14 is provided in an upper region thereof with a mechanical logic system which selectively enables and disables locking mechanism 100 depending upon the position of storage unit 14 relative to adjacent storage units. The positioning of the logic system near the top of the storage unit is not critical, although such positioning enables persons to enter and exit the access aisles between storage units without interference from any of the exposed elements of the system. As shown in FIG. 2B, the logic system includes a pair of operating arms 150 and 152 having the same generally rectangular shape. Thus, operating arm 150 includes a lower edge 150*a* and an upper edge defined by a segment 150*b* which is substantially parallel to edge 150*a*, a segment 150*c* which tapers toward edge 150*a*, and a segment 150*d* which extends substantially parallel to edge 150*a* to define a finger 150*e* which is narrower in width than the remainder of operating arm 150. At the opposite end of operating arm 150, edges 150*a* and 150*b* terminate in a portion 150*f* which protrudes outwardly from the back edge 42 of end member 22. Operating arm 150 is supported by a slotted bracket 154 and a slot 156 in the back edge 42 of end member 22 for sliding in a generally horizontal direction between an extended position in which end portion 105*f* of operating arm 150 protrudes outwardly from back edge 42 by a large amount, and a retracted position in which end portion 150*f* protrudes outwardly from back edge 42 by only a very small amount. A spring 158 connected under tension between operating arm 150 and frame member 38 biases operating arm 150 toward the extended position.

Operating arm 152 is substantially a mirror image of operating arm 150, and includes a lower edge 152*a* and an upper edge defined by a segment 152*b* which is substantially parallel to edge 152*a*, a segment 152*c* which tapers toward edge 152*a*, and a segment 152*d* which extends substantially parallel to edge 152*a* to define a finger 152e which is narrower in width than the remainder of operating arm 152. Opposite end 152*e*, edges 152*a* and 152*b* terminate in a portion 152*f* which protrudes outwardly from the front edge 40 of end member 22. Operating arm 152 is supported by a slotted bracket 160 and a slot 162 in the front edge 40 of end member 22 for sliding in a generally horizontal direction between an extended position in which end portion 152*f* protrudes outwardly from front edge 40 by a large amount, and a retracted position in which end portion 152*f* protrudes outwardly from front edge 40 by only a very small amount. A spring 164 connected under tension between operating arm 152 and frame member 36 biases operating arm 152 toward the extended position.

The logic system further includes a pair of spaced apart linking arms 166 and 168 which extend from upper ends in operative engagement with operating arms 150 and 152, respectively, to lower ends positioned adjacent support plate 106. Linking arms 166 and 168 are free floating in a vertical direction in end member 22 and are guided for movement in this direction by a plurality of slots 170, 172, 174 and 176 formed in frame cross members 46 and 48.

At its upper end, linking arm 166 includes a boss 178 which is arranged to follow upper edge segments 150*b*, 150*c* and 150*d* as operating arm 150 slides between its extended and retracted positions. The upper end of linking arm 166 is also provided with a cam member 180 having a tapered surface 182 and a generally horizontal surface 184 which meet at an apex 183. As will be described further hereinbelow, a pin 186 protruding laterally from finger 150*e* of operating arm 150 coacts with surfaces 182 and 184 during a resetting operation in which locking mechanism 100 is set to an unlocked or free run condition.

The lower end of linking arm 166 lies alongside an upper portion of support plate 106. A recess 190 is formed at a spaced distance from the lower extremity of linking arm 166 in the edge 166*a* of the linking arm facing support plate 106. As will be described further hereinbelow in connection with the operation of the locking mechanism and logic system of the present invention, in predetermined vertical positions of linking arm 166, recess 190 is aligned to receive a pin 192 extending laterally from support plate 106.

Linking arm 168 is substantially a mirror image of linking arm 166, and includes a boss 198 which is arranged to follow upper edge segments 152*b*, 152*c* and 152*d* as operating arm 152 slides between its extended and retracted positions. The upper end of linking arm 168 also includes a cam member 200 having a tapered surface 202 and a generally horizontal surface 204 which meet at an apex 203. Finger 152*e* of operating arm 152 includes a laterally protruding pin 206 which coacts with surfaces 202 and 204 during the resetting of locking mechanism 100 to the unlocked condition.

As with linking arm 166, the lower end of linking arm 168 lies alongside an upper portion of support plate 106. At a spaced distance from its lower extremity, the edge 168*a* of linking arm 168 facing support plate 106 is formed with a recess 194 which is adapted to receive a pin 196 extending laterally from support plate 106 when linking arm 168 is in predetermined vertical positions.

Figure 4:
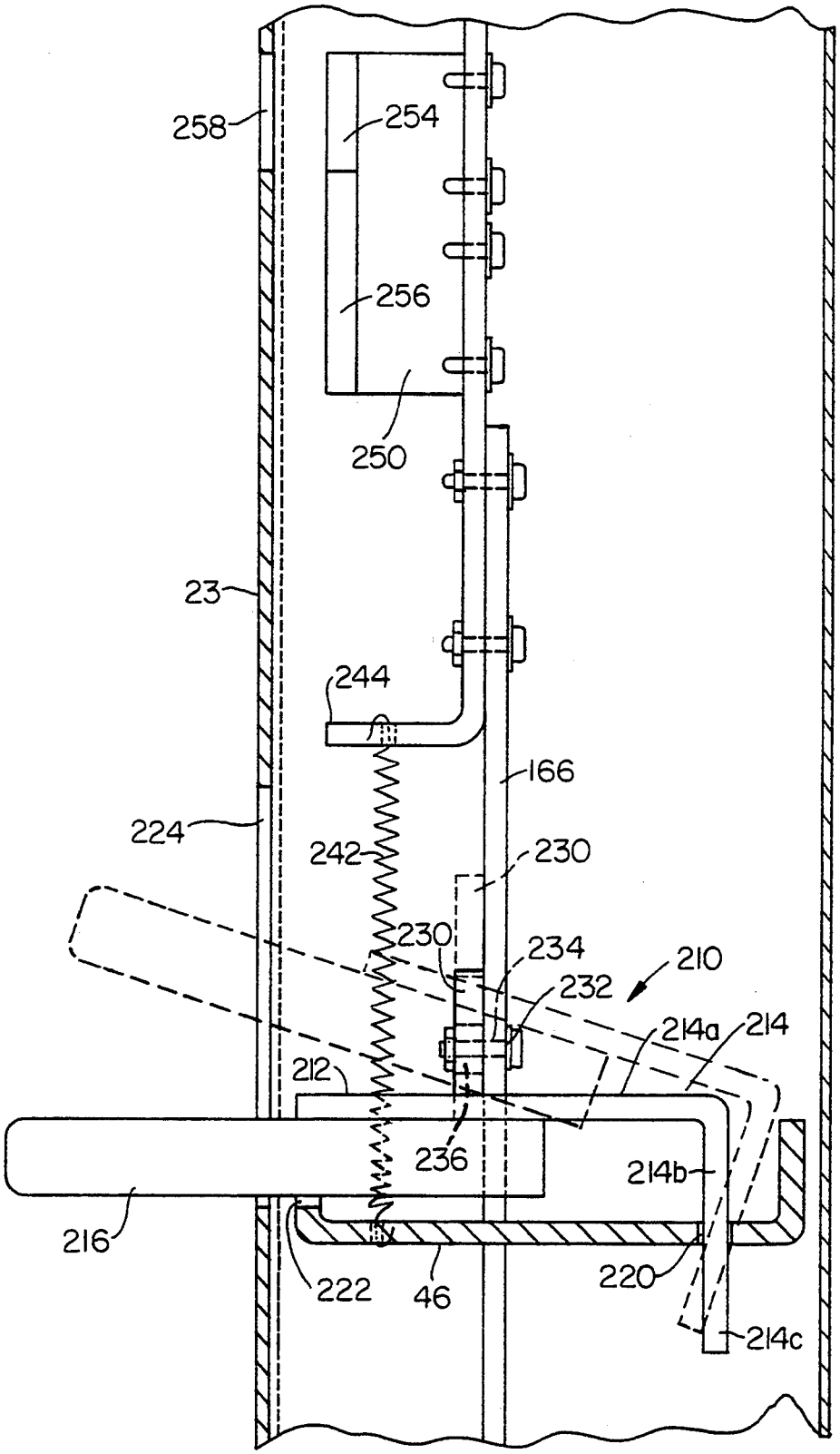
FIG. 4 is an enlarged, schematic, cross-sectional view taken along line 4—4 of FIG. 2A.

A resetting mechanism 210 for resetting the locking mechanism 100 of the present invention to the unlocked or free run condition is shown in FIGS. 2A and 4. Resetting mechanism 210 includes a lever arm 212 having a generally L-shaped hinge member 214 formed by generally perpendicular legs 214*a* and 214*b*, and a handle member 216 connected to leg 214*a*. Leg 214*b* rests upon cross frame member 46 and is located with respect thereto by a tab 214*c* which extends with a loose fit through a slot 220 in the cross frame member. At the other end of lever arm 212, handle member 216 extends through a slot 222 in the cross frame member and a slot 224 in outer panel 23 to define a path through which lever arm 212 is moved during the resetting operation. A release strap 230 is loosely connected to linking arms 166 and 168 immediately above leg 214*a* of lever arm 212. Such connection may be made by threading a shoulder bolt 232 through a fitted aperture in the linking arm (such as aperture 234 in linking arm 166) and a vertically slotted aperture in the release strap (such as slotted aperture 236), or by any other known techniques which enable strap 230 to pivot with respect to linking arms 166 and 168 as the linking arms are moved relative to one another in the vertical direction. The use of slotted apertures for connecting strap 230 to linking arms 166 and 168 permits the linking arms to move relative to one another in the vertical direction without being restricted by strap 230. Generally, linking arms 166 and 168 will be urged downwardly under their own weight. To assure this, resetting mechanism 210 optionally may include a pair of springs 240 and 242 connected between cross frame member 46 and legs 244 and 246 on linking arms 166 and 168 for biasing the linking arms in the downward direction.

Indicators 250 and 252 are provided on linking arms 166 and 168, respectively, for immediately indicating to an operator the condition of locking mechanism 100. In a preferred arrangement, indicator 250 includes two vertically aligned indicia 254 and 256 which are separately viewable through an opening 258 in outer panel 23 depending upon the vertical position of linking arm 166 and, hence, the condition of locking mechanism 100. Thus, when the upper indicia 254, which may be, for example, a red zone or other "no go" indicia, is viewable through opening 258, it indicates that linking arm 166 is in its lowermost position in which this portion of locking mechanism 100 may be in the locked condition, and when the lower indicia 256, which may be, for example, a green zone or other "go" indicia, is viewable through opening 258, it indicates that linking arm 166 is in its uppermost position in which this portion of locking mechanism 100 may be in an unlocked or free run condition. Preferably, the lower indicia 256 is larger in area than the upper indicia 254 so as to be visible through opening 258 when linking arm 166 is in an intermediate position. Indicator 252 includes two similarly aligned indicia 260 and 262 which are viewable through an opening 264 in outer panel 23, again depending upon the condition of locking mechanism 100. Thus, merely by glancing at the end member 22 of storage unit 14, an operator can readily determine the condition of locking mechanism 100 and thus whether storage unit 14 is free for movement in the forward and/or reverse directions.

Figure 5A:
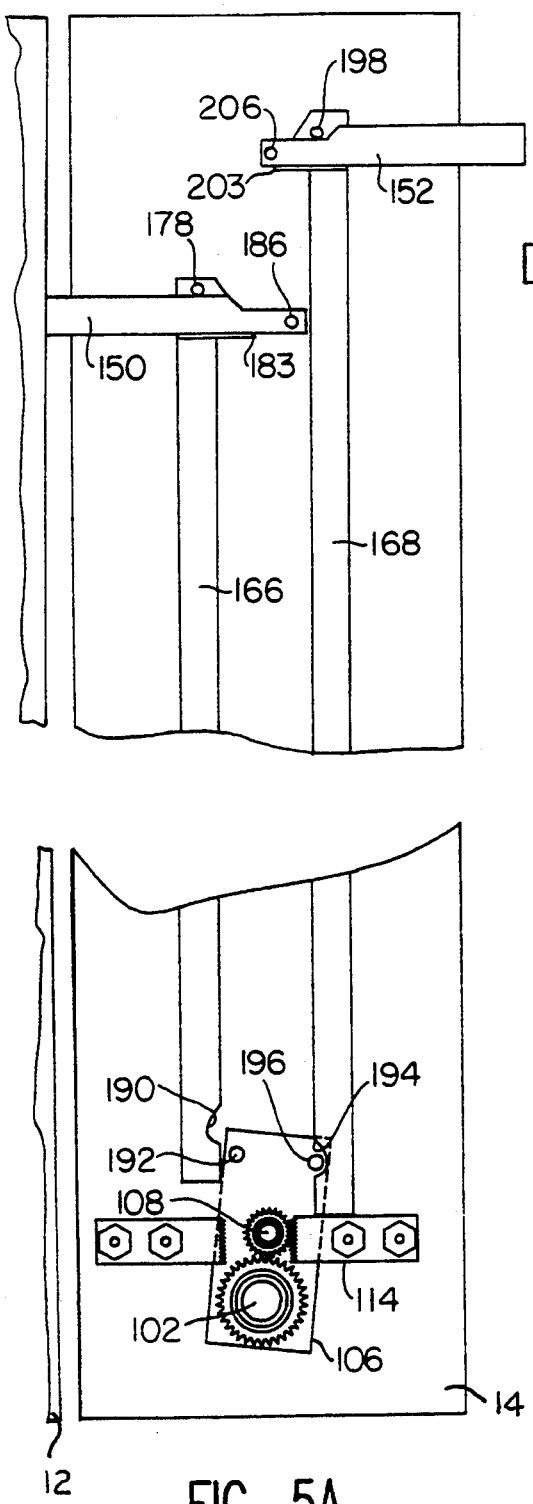
FIGS. 5A–E are enlarged, highly schematic, partial front elevational views of the storage units showing the interaction between the logic system and locking mechanism of the present invention in response to movement of a single storage unit.

The operation of the locking mechanism and logic system of the present invention will now be described with reference to FIGS. 5A–E which show the storage units as viewed from the front. FIG. 5A represents the starting position shown in FIG. 1 in which storage unit 14 has a storage unit 12 immediately to its left and an access aisle immediately to its right. In this position, storage unit 12 will cause operating arm 150 of storage unit 14 to be in the retracted position in which boss 178 is resting upon upper edge segment **150*b* and recess 190 is positioned above pin 192. The green or "go" indicia 256 of indicator 250 will be visible through opening 258 to indicate to an operator that storage unit 14 is not locked by locking mechanism 100 from movement to the left. On the opposite side of storage unit 14 facing the access aisle, operating arm 152 will be in the extended position in which pin 206 is resting against tapered surface 202 of cam member 200, boss 198 is resting upon upper edge segment 152*d* and recess 194 is positioned in alignment with pin 196. From this position, any attempt to rotate operating handle 34 in the clockwise direction of FIG. 5A in order to move storage unit 14 to the right to close the access aisle will cause support plate 106 to rotate in the clockwise direction as pin 196 moves into recess 194. As support plate 106 rotates in the clockwise direction, the teeth of gear 108 will become engaged with the teeth of rack 114. Not only will this engagement prevent support plate 106 from any further rotation in the clockwise direction, but it will prevent handle 34 from further rotation in the clockwise direction as well, thereby locking storage unit 14 from movement toward the right. The red or "no go" indicia 260 on indicator 252 will be visible through opening 264 to indicate this condition of locking mechanism 100** to the operator.

Figure 5B:
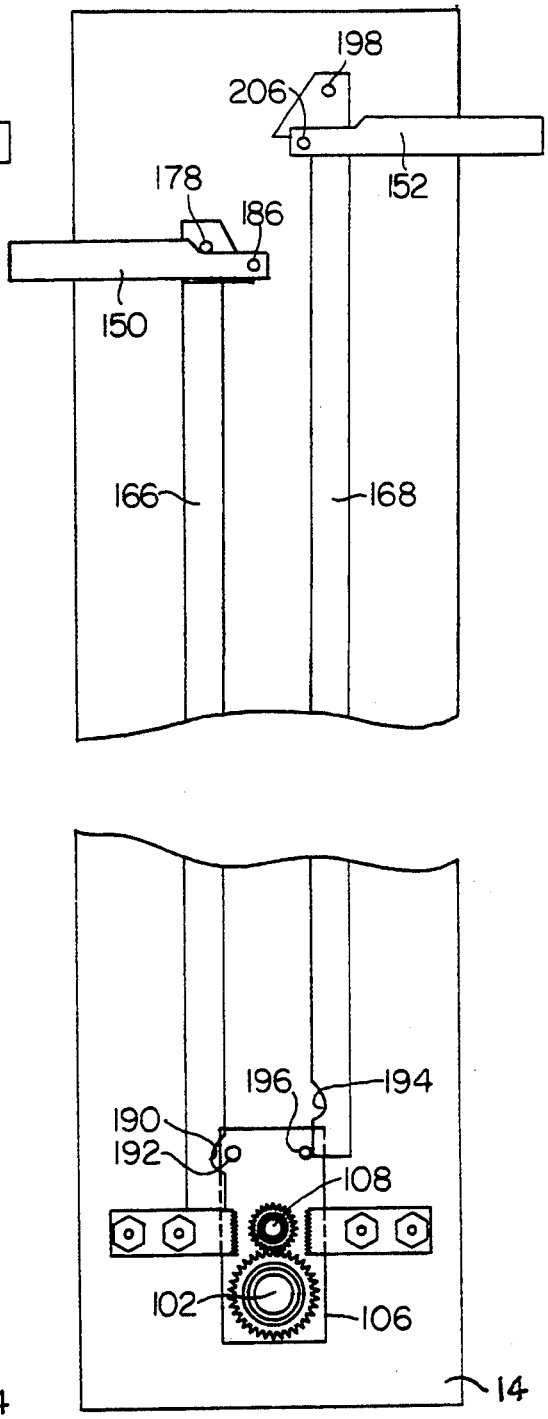

To release storage unit 14 for movement to the right to create an access aisle between storage units 12 and 14, handle member 216 is lifted so as to force release strap 230 and linking arms 166 and 168 connected thereto upwardly. As linking arm 168 moves upwardly, pin 206 will travel along tapered surface 202 of cam member 200, drawing operating arm 152 inwardly toward the retracted position until pin 206 reaches apex 203, at which point spring 164 will draw operating arm 152 outwardly toward the extended position until pin 206 comes to rest against the inner edge **168*a* of linking arm 168, as shown in FIG. 5B. The interaction of pin 206 with horizontal surface 204 will hold linking arm 168 in this raised vertical position as handle member 216 is lowered. At the same time, the upward movement of linking arm 168 to the position shown in FIG. 5B will cause support plate 106 to rotate in a counterclockwise direction toward a generally vertical unlocked condition as pin 196 is urged out from recess 194. As linking arm 168 reaches its final position shown in FIG. 5B, pin 196 will lie against the inner edge 168*a* at the lower extreme of the linking arm. Green indicia 262 will appear in opening 264 to indicate that storage unit 14** is now free for movement to the right.

It will be appreciated that the movement of handle member 216 described above to reset linking arm 168 and locking mechanism 100 from the locked condition of FIG. 5A to the unlocked condition will have no effect on linking arm 166. That is, in the position shown in FIG. 5A, operating arm 150 is in the retracted position such that pin 186 lies beyond apex 183 of cam member 180. As linking arm 166 is moved upwardly in response to the lifting of handle member 216, storage unit 12 will prevent operating arm 150 from retracting to a position in which pin 186 can engage horizontal surface 184 to hold linking arm 166 in this raised position. Hence, as handle member 216 is lowered, linking arm 166 will drop until boss 178 is again resting upon upper edge segment **150*b* of operating arm 150**.

Once linking arm 168 and locking mechanism 100 have been reset to the unlocked condition shown in FIG. 5B, operating handle 34 can be rotated in the clockwise direction of the figure to move storage unit 14 to the right. When operating handle 34 is rotated, gear 102 will rotate with it, thereby urging support plate 106 to move in the clockwise direction. When the support plate begins to move, pin 196 will almost immediately strike edge **168*a* of linking arm 168, blocking support plate 106 from further clockwise movement and thus preventing locking mechanism 100 from entering the locked condition. As a result, gear 108 will merely rotate freely with gear 102 during the continued clockwise rotation of operating handle 34**.

As storage unit 14 moves away from storage unit 12, spring 158 will urge operating arm 150 outwardly to the extended position shown in FIG. 5B, this movement stopping when pin 186 contacts the tapered surface 182 of cam member 180. During this outward movement, boss 178 will travel along the upper edge of operating arm 150 from upper edge segment **150*b* to tapered edge segment 150***c* and then to upper edge segment 150*d*. The movement of boss 178 from upper edge segment 150*b* to upper edge segment 150*d* will cause linking arm 166 to drop by a small amount to the position shown in FIG. 5B in which pin 192 is aligned with recess 190. Therefore, once storage unit 14 has been moved a sufficient distance away from storage unit 12 to enable linking arm 166 to its lowermost position shown in FIG. 5B, locking mechanism 100 will be automatically placed in a condition such that storage unit 14 will be prevented from moving in a reverse direction back toward storage unit 12 without first performing a resetting operation. Red indicia 254 will now be visible through opening 258 to indicate this condition of locking mechanism 100.

Storage unit 14 may continue to move toward the right to create an access aisle between storage units 12 and 14 until storage unit 14 lies immediately adjacent storage unit 16 to its right. As storage unit 14 approaches storage unit 16, operating arm 152 will first contact storage unit 16 whereupon further movement of storage unit 14 to the right will cause operating arm 152 to be depressed to the retracted position shown in FIG. 5C. It should be pointed out here that operating arms 150 and 152 are at offset vertical heights on each of the storage units so that the operating arm 150 of one storage unit will not interfere with the operating arm 152 of the adjacent storage unit. As operating arm 152 moves inwardly, pin 206 will travel along horizontal surface 204 of cam member 200 until it reaches apex 203. As operating arm 152 moves in a small amount more so that pin 206 is beyond apex 203, linking arm 168 will be totally unsupported and will therefore drop until boss 198 comes to rest upon upper edge segment 152*b*. In this position of linking arm 168, recess 194 will still be positioned above pin 196, and green indicia 262 will remain visible through opening 264. Linking arm 166 will remain in its lowermost position with pin 192 in alignment with recess 190 such that any attempt to rotate operating handle 34 in a counterclockwise direction in order to move storage unit 14 to the left to close the newly created access aisle will cause support plate 106 to rotate in the counterclockwise direction as pin 192 moves into recess 190. Support plate 106 will continue to rotate in the counterclockwise direction until the teeth of gear 108 become engaged with the teeth of rack 116, whereupon storage unit 14 will be locked from movement toward the left.

Figure 5C:
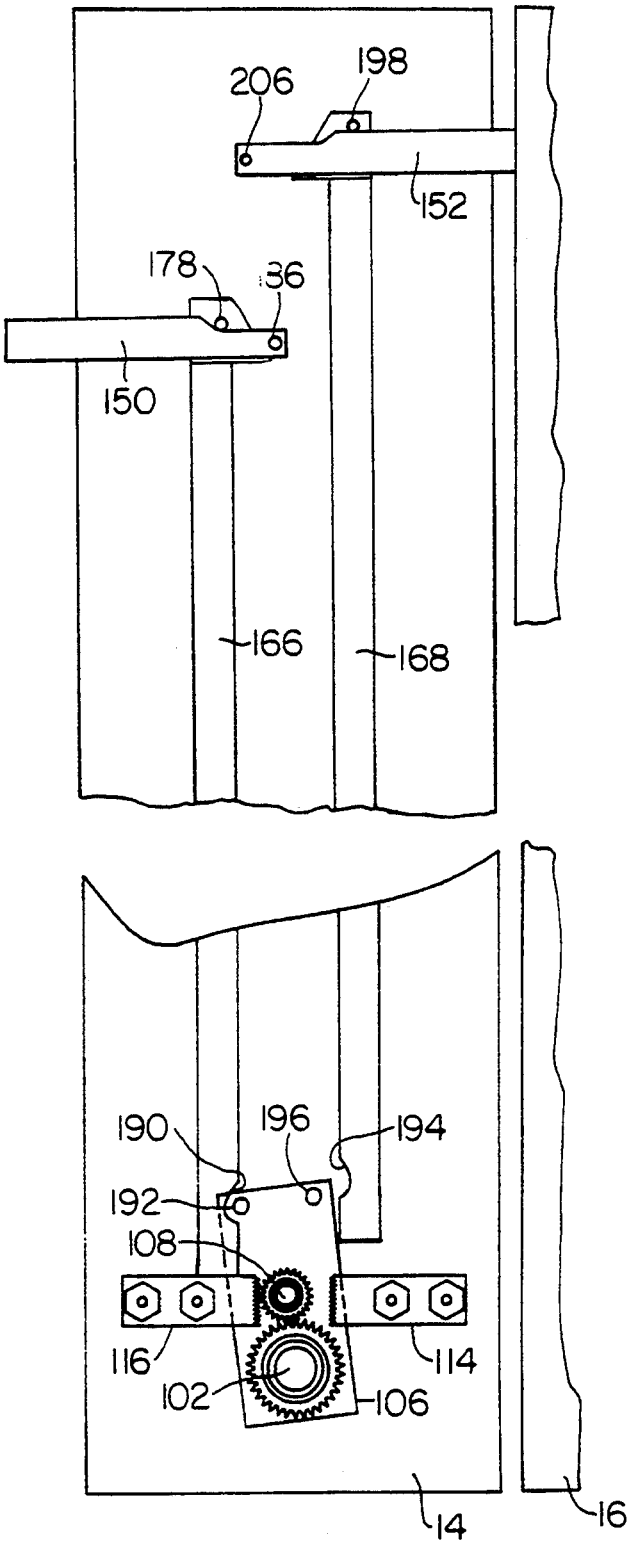

Again, before storage unit 14 can be moved to the left, locking mechanism 100 must be reset to the unlocked condition by lifting handle member 216. In this case, as linking arm 166 moves upwardly, pin 186 will travel along tapered surface 182 of cam member 180, drawing operating arm 150 inwardly toward the retracted position until pin 186 reaches apex 183, at which point spring 158 will urge operating arm 150 toward the extended position shown in FIG. 5D, with pin 186 resting against the inner edge 166*a* of linking arm 166. The interaction of pin 186 with horizontal surface will hold linking arm 166 in this raised vertical position as handle member 216 is lowered. The upward movement of linking arm 166 causes support plate 106 to rotate in a clockwise direction toward the generally vertical unlocked condition as pin 192 is urged out from recess 190. When linking arm 166 reaches the position shown in FIG. 5D, pin 192 will lie against the inner edge 166*a* at the lower extreme of the linking arm, and green indicia 256 will be visible through opening 258. Again, the movement of handle member 216 to reset linking arm 166 and locking mechanism 100 from the locked condition of FIG. 5C to the unlocked condition will have no effect on linking arm 168 since pin 206 lies beyond apex 203 of cam member 200 and will therefore be unable to engage horizontal surface 204 to hold linking arm 168 in the raised position. As a result, linking arm 168 will drop as handle member 216 is lowered until boss 198 is again resting upon upper edge segment 152*b* of operating arm 152, as shown in FIG. 5C.

Following this resetting operation, operating handle 34 can be rotated in a counterclockwise direction to move storage unit 14 to the left. Gear 102 will, of course, rotate with the operating handle, urging support plate 106 to move in the counterclockwise direction. As this movement begins, pin 192 will almost immediately strike edge 166*a* of linking arm 166, blocking support plate 106 from further movement in the counterclockwise direction so that locking mechanism 100 cannot enter the locked condition. Hence, as the counterclockwise rotation of operating handle 34 continues, gear 108 will merely rotate freely with gear 102.

Figure 5D:
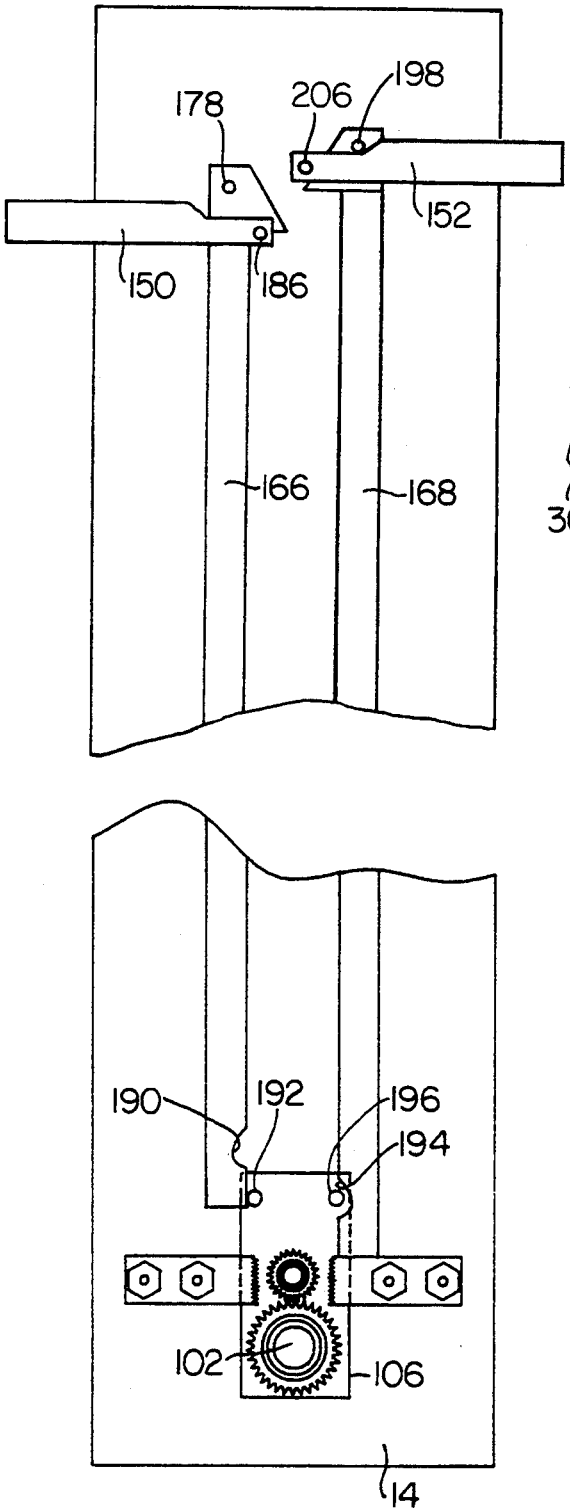

As storage unit 14 is moved to the left away from storage unit 16, spring 164 will urge operating arm 152 outwardly to the extended position shown in FIG. 5D until the point where pin 206 contacts the tapered surface 202 of cam member 200. During the outward movement of operating arm 152, boss 198 will follow the upper edge of operating arm 152 along upper edge segment 152*b* and tapered edge segment 152*c* until it reaches upper edge segment 152d. The movement of boss 198 from upper edge segment 152*b* to upper edge segment 152*d* will cause linking arm 168 to drop by a small amount to the position shown in FIG. 5D in which pin 196 is aligned with recess 194. Thus, once storage unit 14 has been moved a sufficient distance away from storage unit 16 to enable linking arm 168 to drop to its lowermost position shown in FIG. 5D, locking mechanism 100 will be automatically placed in a condition such that storage unit 14 will be prevented from moving in a reverse direction back toward storage unit 16 without first performing a resetting operation. Red indicia 260 will now be visible through opening 264 to indicate this condition of locking mechanism 100.

Figure 5E:
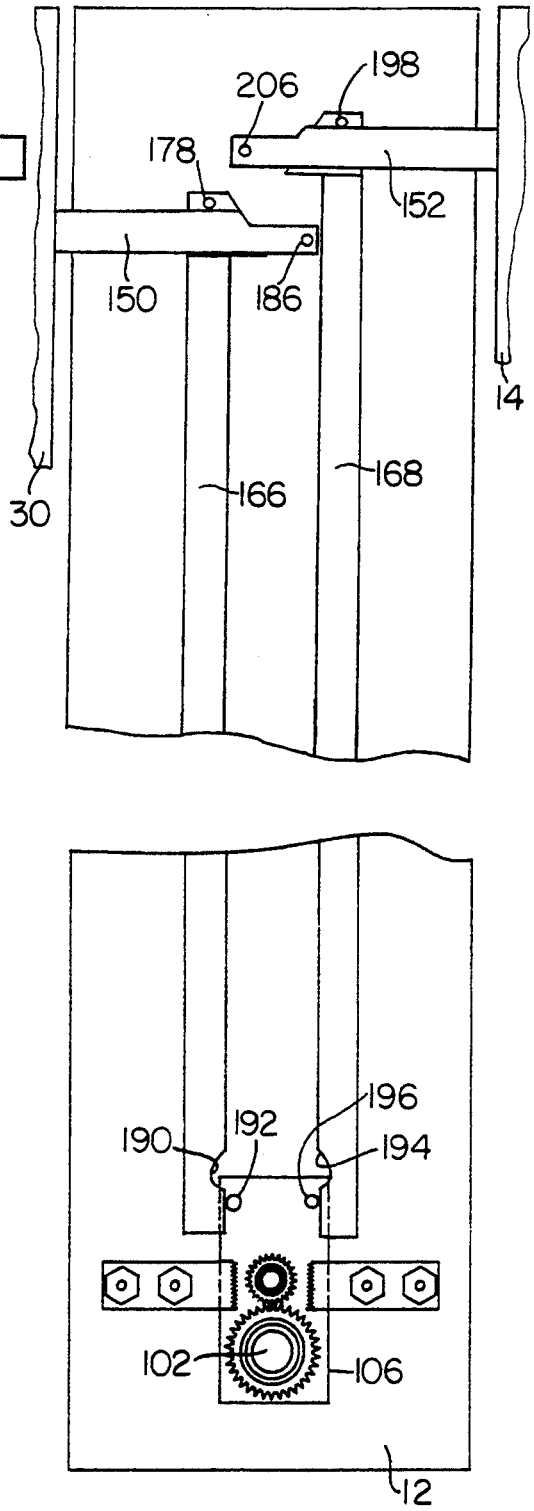

The locking mechanism 100 and locking system of the present invention operate in essentially the same fashion in those situations where it is desirable to move more than one storage unit at a time. For example, referring to FIG. 1, it may be desirable to move both of storage units 12 and 14 to the right in order to create an access aisle between storage unit 12 and stationary storage unit 30. The condition of the logic system and locking mechanism 100 of storage unit 12 sandwiched between storage units 14 and 30 is shown in FIG. 5E. As illustrated, the proximity of storage unit 30 causes operating arm 150 of storage unit 12 to be in the retracted position in which boss 178 is resting upon upper edge segment 150*b* and recess 190 is positioned above pin 192. The proximity of storage unit 14 on the other side of storage unit 12 causes operating arm 152 of storage unit 12 also to be in the retracted position in which boss 198 is resting upon upper edge segment 152*b* and recess 194 is positioned above pin 196. In this unlocked condition of locking mechanism 100, both of green indicia 256 and 262 will be visible through the respective openings in the outer panel 23 of storage unit 12. Storage unit 14, however, is in the locked condition described above in connection with FIG. 5A. Thus, in order to simultaneously move storage units 12 and 14 for movement to the right, the locking mechanism 100 of storage unit 14 must be reset by following the procedure described above for releasing storage unit 14 for movement to the right. When this reset operation has been completed, operating handle 34 on storage unit 12 can be rotated in a clockwise direction to simultaneously move both storage units to the right. When storage unit 12 has been moved a sufficient distance from storage unit 30, operating arm 150 of storage unit 12 will move to the extended position, thus placing locking mechanism 100 of storage unit 12 in a condition such that storage unit 12 will be prevented from moving in a reverse direction back towards storage unit 30 without first being reset. Since the simultaneous movement of storage units 12 and 14 does not create any space between these two storage units, no change in the condition of locking mechanism 100 in storage unit 14 will take place until the storage units near the end of their travel and the operating arm 152 of storage unit 14 contacts storage unit 18.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as set forth in the appended claims.

I claim:

1. A locking mechanism, comprising a frame, a shaft rotatably mounted to said frame, means for rotating said shaft, a first gear mounted on said shaft for rotation therewith, a support member mounted on said shaft for movement with respect to said frame in a first path between a first lock position and a free run position, a second gear mounted on said support member for rotation relative to said support member, said second gear being in mesh with said first gear, a first arresting member mounted to said frame for engaging said second gear to thereby prevent rotation of said shaft in a first direction when said support member is in said first lock position, said first arresting member being disengaged from said second gear when said support member is in said free run position, movement means for urging said support member toward said first lock position responsive to rotation of said shaft in said first direction, and blocking means for selectively blocking the movement of said support member to said first lock position.

2. The locking mechanism as claimed in claim 1, wherein said first arresting member comprises a toothed member.

3. The locking mechanism as claimed in claim 1, wherein said movement means comprises drag means for rotatably coupling said support member to said first gear.

4. The locking mechanism as claimed in claim 3, wherein said drag means comprises biasing means for creating a coupling force to rotatably couple said support member to said first gear.

5. The locking mechanism as claimed in claim 4, wherein said coupling force rotatably couples said support member to said second gear.

6. The locking mechanism as claimed in claim 1, wherein said movement means urges said support member toward said free run position responsive to rotation of said shaft in a second direction.

7. The locking mechanism as claimed in claim 1, wherein said blocking means comprises a first blocking member movable into said first path for blocking the movement of said support member to said first lock position and movable out from said first path for releasing said support member for movement into said first lock position.

8. The locking mechanism as claimed in claim 7, further comprising reset means for moving said support member from said first lock position to said free run position.

9. The locking mechanism as claimed in claim 1, wherein said shaft is rotatable about a first axis of rotation and said second gear is rotatable about a second axis of rotation parallel to said first axis of rotation.

10. The locking mechanism as claimed in claim 1, wherein said support member is further movable in a second path between a second lock position and said free run position, said locking mechanism further comprising a second arresting member mounted to said frame for engaging said second gear to thereby prevent rotation of said shaft in a second direction when said support member is in said second lock position, said second arresting member being disengaged from said second gear when said support member is in said free run position.

11. The locking mechanism as claimed in claim 10, wherein said movement means urges said support member toward said second lock position responsive to rotation of said shaft in said second direction.

12. The locking mechanism as claimed in claim 10, wherein said first and second arresting members comprise toothed members.

13. The locking mechanism as claimed in claim 10, wherein said movement means comprises drag means for rotatably coupling said support member to said first gear.

14. The locking mechanism as claimed in claim 13, wherein said drag means comprises biasing means for creating a coupling force to rotatably couple said support member to said first gear.

15. The locking mechanism as claimed in claim 14, wherein said coupling force rotatably couples said support member to said second gear.

16. The locking mechanism as claimed in claim 10, wherein said blocking means comprises a first blocking member movable into said first path for blocking the movement of said support member to said first lock position and movable out from said first path for releasing said support member for movement into said first lock position, and a second blocking member movable into said second path for blocking the movement of said support member to said second lock position and movable out from said second path for releasing said support member for movement into said second lock position.

17. The locking mechanism as claimed in claim 16, further comprising reset means for moving said support member from said first and second lock positions to said free run position.

18. The locking mechanism as claimed in claim 10, wherein said shaft is rotatable about a first axis of rotation and said second gear is rotatable about a second axis of rotation parallel to said first axis of rotation.

19. A movable storage system, comprising a first movable storage unit having a frame, a drive mechanism including a shaft rotatably mounted to said frame for moving said storage unit in forward and reverse directions, and locking means for selectively preventing the movement of said storage unit in at least one of said forward and reverse directions, said locking means including a first gear mounted on said shaft for rotation therewith, a support member mounted on said shaft for movement with respect to said frame in a first path between a first lock position and a free run position, a second gear mounted on said support member for rotation relative to said support member, said second gear being in mesh with said first gear, a first arresting member mounted to said frame for engaging said second gear to thereby prevent rotation of said shaft in a first direction when said support member is in said first lock position, said first arresting member being disengaged from said second gear when said support member is in said free run position, movement means for urging said support member toward said first lock position responsive to rotation of said shaft in said first direction, and blocking means for selectively blocking the movement of said support member to said first lock position.

20. The system as claimed in claim 19, wherein said blocking means comprises a first blocking member movable into said first path for blocking the movement of said support member into said first lock position and movable out from said first path for releasing said support member for movement into said first lock position.

21. The system as claimed in claim 20, further comprising a second storage unit positioned so that movement of said first storage unit in said forward direction moves said first storage unit toward said second storage unit and movement of said first storage unit in said reverse direction moves said first storage unit away from said second storage unit, and control means for controlling the movement of said first blocking member in response to a distance between said first and second storage units.

22. The system as claimed in claim 21, wherein said control means comprises a first operating mechanism including a first operating arm movable between an extended position when said distance between said first and second storage units is greater than a threshold distance and a retracted position when said distance between said first and second storage units is less than said threshold distance, and response means for moving said first blocking member into said first path responsive to movement of said first operating arm from said extended position to said retracted position.

23. The system as claimed in claim 22, wherein said response means includes a first linking arm connected to said first blocking member and first cam means operable between said first linking arm and said first operating arm for moving said first blocking member with respect to said first path in response to movement of said first operating arm between said extended and retracted positions.

24. The system as claimed in claim 19, further comprising reset means for moving said support member from said first lock position to said free run position.

25. The system as claimed in claim 19, wherein said support member is further movable in a second path between a second lock position and said free run position, said locking means further including a second arresting member mounted to said frame for engaging said second gear to thereby prevent rotation of said shaft in a second direction when said support member is in said second lock position, said second arresting member being disengaged from said second gear when said support member is in said free run position.

26. The system as claimed in claim 25, wherein said movement means urges said support member toward said second lock position responsive to rotation of said shaft in said second direction.

27. The system as claimed in claim 26, wherein said movement means comprises drag means for rotatably coupling said support member to said first gear.

28. The system as claimed in claim 25, wherein said blocking means comprises a first blocking member movable into said first path for blocking the movement of said support member into said first lock position and movable out from said first path for releasing said support member for movement into said first lock position, and a second blocking member movable into said second path for blocking the movement of said support member into said second lock position and movable out from said second path for releasing said support member for movement into said second lock position.

29. The system as claimed in claim 28, further comprising second and third storage units positioned so that movement of said first storage unit in said forward direction moves said first storage unit toward said second storage unit and away from said third storage unit and movement of said first storage unit in said reverse direction moves said first storage unit away from said second storage unit and toward said third storage unit, and control means for controlling the movement of said first blocking member in response to a first distance between said first and second storage units and for controlling the movement of said second blocking member in response to a second distance between said first and third storage units.

30. The system as claimed in claim 29, wherein said control means comprises a first operating mechanism including a first operating arm moveable between an extended position when said distance between said first and second storage units is greater than a threshold distance and a retracted position when said distance between said first and second storage units is less than said threshold distance, first response means for moving said first blocking member into said first path responsive to movement of said first operating arm from said extended position to said retracted position, a second operating mechanism including a second operating arm moveable between an extended position when said distance between said first and third storage units is greater than said threshold distance and a retracted position when said distance between said first and third storage units is less than said threshold distance, and second response means for moving said second blocking member into said second path responsive to movement of said second operating arm from said extended position to said retracted position.

31. The system as claimed in claim 30, wherein said first response means includes a first linking arm connected to said first blocking member and first cam means operable between said first linking arm and said first operating arm for moving said first blocking member with respect to said first path in response to movement of said first operating arm between said extended and retracted positions, and wherein said second response means includes a second linking arm connected to said second blocking member and second cam means operable between said second linking arm and said second operating arm for moving said second blocking member with respect to said second path in response to movement of said second operating arm between said extended and retracted positions.

32. The system as claimed in claim 31, further comprising reset means for moving said support member from said first and second lock positions to said free run position.

33. The system as claimed in claim 32, wherein said reset means includes a reset lever operatively connected to said first and second linking arms, movement of said reset lever from a rest position to a reset position simultaneously moving said first blocking member into said first path and said second blocking member into said second path.

* * * * *

UNITED STATES PATENT AND TRADEMARK OFFICE

CERTIFICATE OF CORRECTION

PATENT NO. : 5,360,262

DATED : November 1, 1994

INVENTOR(S) : Davidian

It is certified that error appears in the above-identified patent and that said Letters Patent is hereby corrected as shown below:

Column 11, line 58, "surface will" should read --surface 184 will--.

Signed and Sealed this

Twentieth Day of December, 1994

Bruce Lehman

BRUCE LEHMAN

*Commissioner of Patents and Trademarks*

*Attest:*

*Attesting Officer*